US012151175B2

(12) United States Patent
Vuu et al.

(10) Patent No.: US 12,151,175 B2
(45) Date of Patent: Nov. 26, 2024

(54) ADAPTIVE TIC TAC TOE BOARD

(71) Applicants: Thuan Minh Vuu, Orlando, FL (US); Emily Wissner Gartenberg, Orlando, FL (US)

(72) Inventors: Thuan Minh Vuu, Orlando, FL (US); Emily Wissner Gartenberg, Orlando, FL (US)

(73) Assignee: Vuu Rehabilitation PLLC, Orlando, FL (US)

( * ) Notice: Subject to any disclaimer, the term of this patent is extended or adjusted under 35 U.S.C. 154(b) by 437 days.

(21) Appl. No.: 17/454,566

(22) Filed: Nov. 11, 2021

(65) Prior Publication Data

US 2022/0080295 A1 Mar. 17, 2022

Related U.S. Application Data

(60) Provisional application No. 63/077,480, filed on Sep. 11, 2020.

(51) Int. Cl.
*A63F 3/00* (2006.01)

(52) U.S. Cl.
CPC ..... *A63F 3/00094* (2013.01); *A63F 3/00697* (2013.01); *A63F 2003/00839* (2013.01)

(58) Field of Classification Search
CPC ..... A63F 3/00094; A63F 3/00697; A63F 2003/00839; A63F 2003/00605; A63F 2003/00801; A63F 3/00574
See application file for complete search history.

(56) References Cited

U.S. PATENT DOCUMENTS

| | | | | |
|---|---|---|---|---|
| 1,288,924 | A * | 12/1918 | Knoos, Jr. | A63F 3/00574 273/290 |
| 2,536,188 | A * | 1/1951 | Kulakusky | A63F 1/18 235/90 |
| 2,801,107 | A | 7/1957 | Greer, Jr. | |
| 3,747,926 | A | 7/1973 | Odom | |
| 3,751,039 | A | 8/1973 | Dykoski | |
| 3,770,273 | A | 11/1973 | Reiner | |
| 3,879,040 | A | 4/1975 | Smith | |
| 4,497,491 | A | 2/1985 | Holman | |
| 5,318,307 | A | 6/1994 | Bouchard et al. | |
| 6,293,550 | B1 | 9/2001 | Zeitlin | |
| 8,505,918 | B1 | 8/2013 | Appelblatt | |
| 8,651,488 | B2 | 2/2014 | Mulholland | |
| 8,992,229 | B2 * | 3/2015 | Spital | A63F 9/00 434/259 |
| D741,410 | S | 10/2015 | Mandaher | |

(Continued)

OTHER PUBLICATIONS

"Tic-Tac-Toe, Wooden"; published Apr. 24, 2015 at http://www.braillebookstore.com/Tic--Tac--Toe,-Wooden.1; retrieved at https://web.archive.org/web/20150424104452/http://www.braillebookstore.com/Tic--Tac--Toe,-Wooden. 1 (Year: 2015).*

*Primary Examiner* — Michael D Dennis
(74) *Attorney, Agent, or Firm* — Dunlap Bennett & Ludwig, PLLC

(57) ABSTRACT

An improved tic tac toe game is herein disclosed. The game pieces include X-pieces or O-pieces that are coupled to hollow cylinder pieces, resulting in large pieces that are shaped and sized to easily grip and operate. In use, these game pieces are placed over pegs the project upwardly from a game board base to play tic tac toe.

16 Claims, 3 Drawing Sheets

(56) References Cited

U.S. PATENT DOCUMENTS

| | | | | |
|---|---|---|---|---|
| 9,895,600 | B2 * | 2/2018 | Johnson | A63F 3/02 |
| 10,099,112 | B1 | 10/2018 | Johnson | |
| 10,729,970 | B1 | 8/2020 | Yenidogan | |
| 2008/0258386 | A1 | 10/2008 | Eastman | |
| 2014/0004491 | A1 | 1/2014 | Scheidl | |
| 2016/0243431 | A1 | 8/2016 | Peterson | |

* cited by examiner

ADAPTIVE TIC TAC TOE BOARD

CROSS-REFERENCE TO RELATED APPLICATION

This application claims the benefit of priority of U.S. provisional application No. 63/077,480, filed Sep. 11, 2020, the contents of which are herein incorporated by reference.

BACKGROUND OF THE INVENTION

The present invention relates to tic tac toe boards and, more particularly, to an adaptive tic tac toe board for people of all abilities.

Individuals with cognitive or motor disabilities often have difficulty playing tic tac toe because they cannot hold the pieces and place them in the correct locations independently. Existing tic tac toe game pieces are challenging to grasp and require specific abilities to place the pieces in the desired locations.

Typically, tic tac toe boards use flat pieces in the shapes of X and O, which fit into pre-cut slots. Due to their configuration (e.g., small size, flat shape, and design of the board), individuals with decreased cognitive and/or motor abilities can drop the pieces or require significant assistance to place them.

As can be seen, there is a need for an improved tic tac toe board and playing pieces. The adaptive tic tac toe board described herein provides large, cylindrical playing pieces, making handling easier for people of all abilities.

SUMMARY OF THE INVENTION

In one aspect of the present invention, a tic tac toe game comprises: a game board comprising a base board and a plurality of pegs extending vertically upwardly from the base board; a plurality of first game pieces, each first game piece comprising a cylinder piece and an O-piece coupled thereto; and a plurality of second game pieces, each second game piece comprising the cylinder piece and an X-piece coupled thereto, wherein each cylinder piece defines a cavity therein and, in use, the first game pieces and the second game pieces are placed over the plurality of pegs, with the plurality of pegs being received within the cavities of the cylinder pieces.

In another aspect of the present invention, a method of playing a game of tic tac toe comprises the steps of: providing a game board comprising a base board and a plurality of pegs extending vertically upwardly from the base board; providing a plurality of first game pieces, each first game piece comprising a cylinder piece and an O-piece coupled thereto; and providing a plurality of second game pieces, each second game piece comprising the cylinder piece and an X-piece coupled thereto; defining a cavity in each cylinder piece; and placing the first game pieces and the second game pieces over the plurality of pegs, with the plurality of pegs being received within the cavities of the cylinder pieces.

These and other features, aspects and advantages of the present invention will become better understood with reference to the following drawings, description, and claims.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

Figure 1:
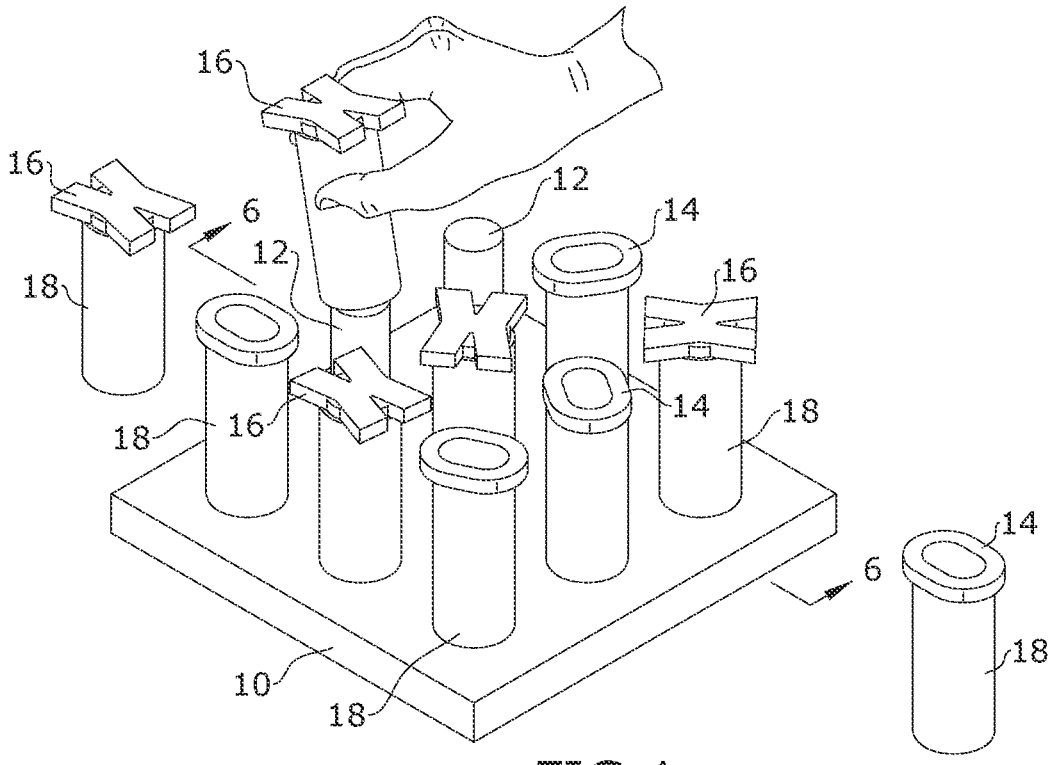
FIG. 1 is a perspective view of an embodiment of the present invention.

The subject disclosure is described with reference to the drawings, wherein like reference numerals are used to refer to like elements throughout. In the following description, for purposes of explanation, numerous specific details are set forth in order to provide a thorough understanding of the present disclosure such that one skilled in the art will be enabled to make and use the present invention. It may be evident, however, that the present disclosure may be practiced without some of these specific details.

As stated above, individuals with cognitive or motor disabilities can have difficulties playing tic tac toe because they cannot hold the pieces or place them in the correct locations independently. The invention claimed here solves this problem.

The adaptive tic tac toe board will allow individuals to play independently by grasping the game pieces and placing them on the pegs. The game pieces are sturdier and larger than other game forms, so fewer fine-motor skills are required.

Figure 2:
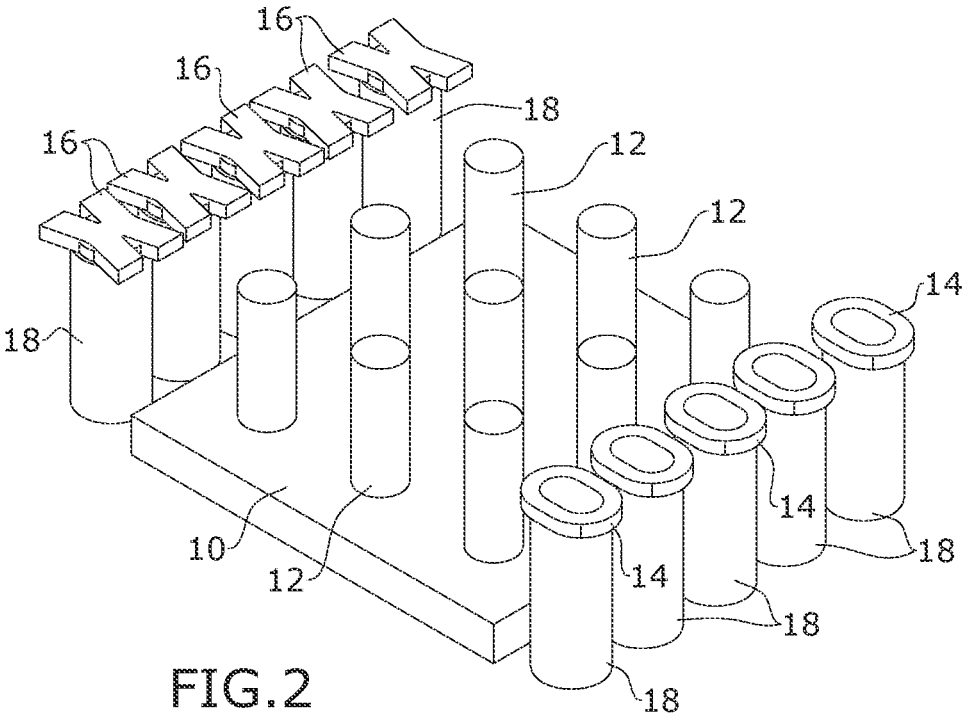
FIG. 2 is a perspective view of the embodiment of the present invention.
Figure 3:
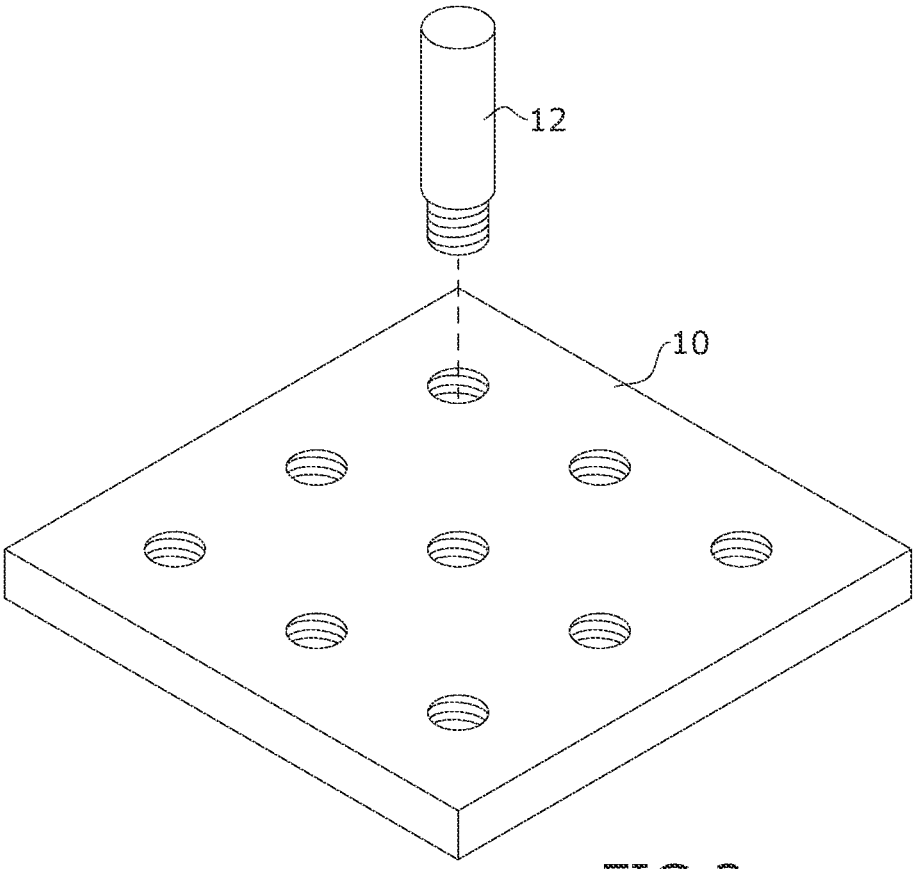
FIG. 3 is an exploded view of a base of the embodiment of the resent invention.
Figure 4:
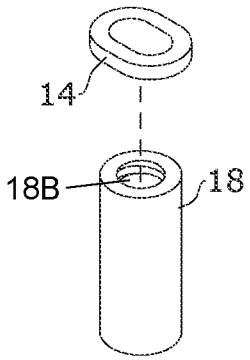
FIG. 4 is an exploded view of the O pieces of the embodiment of the present invention.

Broadly, one embodiment of the present invention is an easy-to-use tic tac toe game with large game pieces that are easy to grip and operate. Referring now to FIGS. 1 and 4, a tic tac toe game of the present invention includes a game board that includes a base board 10 with pegs/rods 12 attached non-permanently (e.g., by screwing in) thereto. As shown, for example, in FIG. 2, the pegs 12 are substantially cylindrical in shape and extend vertically upward from the base board 10. This allows for easy disassembly when the game is not being used. The base board 10 and pegs 12 may be made from various appropriate materials including, but not limited to, plastics, foam, wood, and combinations thereof.

A plurality of hollow cylinder pieces 18 each include a wide diameter opening 18A at a lower side and a narrower diameter opening 18B at an upper side, with a substantially cylindrical cavity 18D being defined therebetween. A plurality of O-pieces 14 and X-pieces 16 are further provided that couple to the upper side of the hollow cylinders 18. In certain embodiments, a coupling member 14A, 16A of the respective pieces 14, 16 may snapably engage a recessed lip portion 18C of the upper side of the cylinder pieces 18. Thus, the X-pieces 16 and the O-pieces 14 may be uncoupled from the cylinders 18, as needed (e.g., to clean the set or replace a broken part). The cylinder pieces 18, X-pieces, and O-pieces may be formed from various appropriate materials, including, but not limited to, plastics, foam, and combinations thereof. Any appropriate method of manufacture may be used to produce the components of the present invention. By way of example, they may be 3D modeled, and manufactured through plastic printing. As will be appreciated by those with skill in the art, other methods may be used, based on material and cost considerations.

Figure 5:
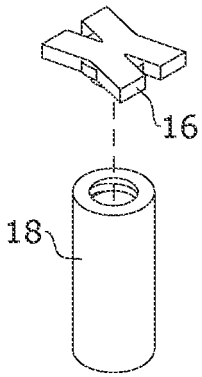
FIG. 5 is an exploded view of the X pieces of the embodiment of the present invention
Figure 6:
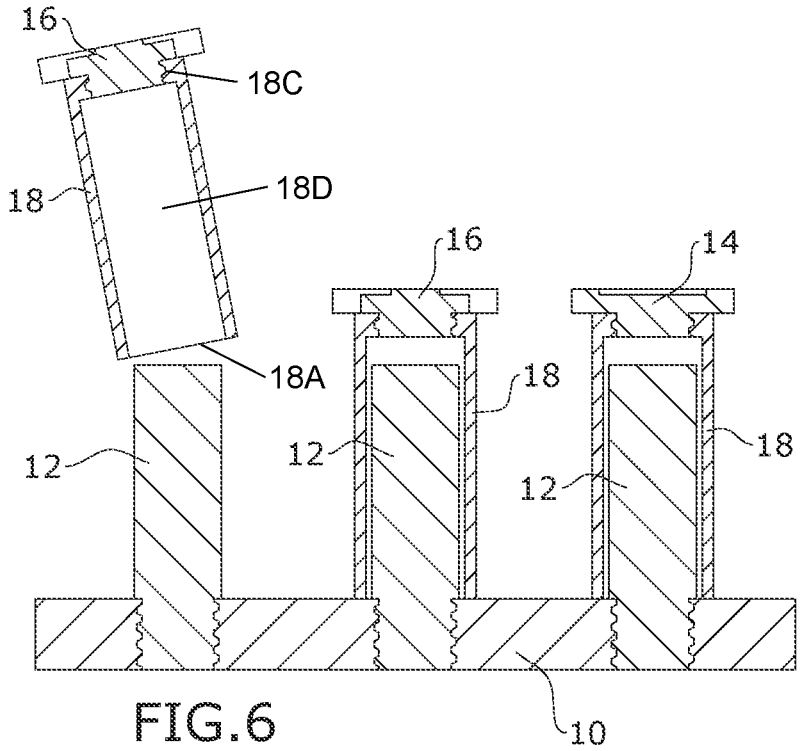
FIG. 6 is a section view of the embodiment of the present invention, taken along line 6-6 in FIG. 1.
Figure 7:
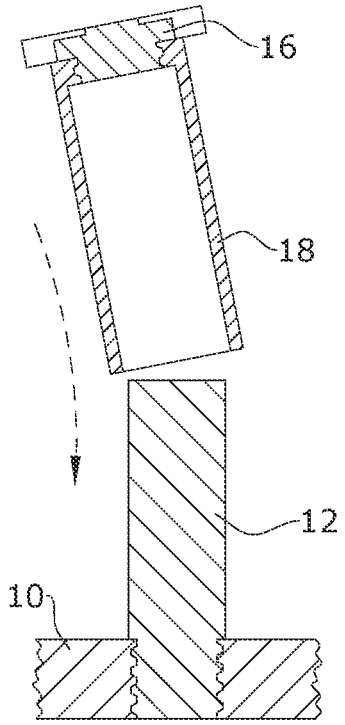
FIG. 7 is a detailed section view of the embodiment of the present invention.

To use, the tic tac toe game is first assembled, as described above, and generally illustrated in FIGS. 4-6. This results in an assembled board 10 with pegs 12, and a plurality of game pieces (the assembly of the X-pieces 16 and the O-pieces 14). As shown in FIGS. 1, 7 and 8, a player places their respective X-piece 16 or O-piece 14 over a peg 12, with the objective being to align three X's or three O's in a row, in any direction, before their opponent (as in a traditional game of tic tac toe where problem-solving skills are required). Referring to FIG. 1, because of the cylindrical shapes used, the orientation of the X's and O's does not need to be perfectly aligned in order for a player to place the game piece over the peg 12 (and are thus, freely rotatable to be positioned in any orientation). As demonstrated in FIG. 7, an inner diameter of the cavity 18D of the hollowed cylinder piece 18 is slightly larger than a diameter of the peg 12, making it easier for a player to place their O-or-X-piece 14, 16 over the peg 12. Further, the cylinder pieces 18 are shaped and dimensioned such that they substantially cover the pegs 12, in use, thus securely maintaining the game pieces in place.

The enlarged opening on the hollowed cylinder pieces 18, in combination with the pegs 12 protruding outwardly from the board 10 and the larger overall size of the game pieces (the cylinder 12 and assembled O/X-piece 14, 16), among other novel features (as discussed above), significantly improves the ease in which an individual with decreased cognitive and/or motor abilities can play a game of tic tac toe. Further, this improved tic tac toe game helps to improve a player's manual and mental dexterity due to its unique design.

This tic tac toe game can be used across many different therapy or school settings. For example, toddlers or individuals with motor or cognitive issues can use the game to improve their ability to manipulate and coordinate objects. Because the O/X-pieces 14, 16 can be removed from the cylinder pieces 18, additional pieces could be substituted to create a different game. For example, numbers or a series of letters could be provided so that the player must put them correctly in order. Further, a blank tile could be created for a word to be written and assembled on the cylinders 18 so complete sentences can be created.

While one or more preferred embodiments are disclosed, many other implementations will occur to one of ordinary skill in the art and are all within the scope of the invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. Other arrangements, methods, modifications, and substitutions by one of ordinary skill in the art are therefore also considered to be within the scope of the present invention, which is not to be limited except by the claims that follow.

While apparatuses and methods are described in terms of "comprising," "containing," or "including" various components or steps, the apparatuses and methods can also "consist essentially of" or "consist of" the various components and steps. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted. Moreover, the use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

What is claimed is:

1. A tic tac toe game comprising: a game board comprising a base board and a plurality of pegs extending vertically upwardly from the base board; a plurality of first game pieces, each first game piece comprising a cylinder piece and an O-piece coupled thereto; and a plurality of second game pieces, each second game piece comprising a cylinder piece and an X-piece coupled thereto, wherein each cylinder piece defines a cavity therein, wherein each cylinder piece of the first and second game pieces provides a recessed lip adjacent an upper end thereof so that each respective O-piece or X-piece is snapably engageable to the recessed lip, whereby individuals are enabled to removably substitute the pluralities of game pieces and, whereby in use, the first game pieces and the second game pieces are placed over the plurality of pegs, with the plurality of pegs being received within the cavities of the cylinder pieces; further comprising blank tiles, wherein each blank tile comprises a tile protrusion projecting from a lower surface thereof, wherein each tile protrusion has a radial tile ridge dimensioned and shaped to facilitate the snapable engagement.

2. The tic tac toe game of claim 1, wherein, when the first game pieces and the second game pieces are placed over the plurality of pegs, the plurality of first game pieces and the plurality of second game pieces are configured to substantially cover the plurality of pegs.

3. The tic tac toe game of claim 2, wherein, when the first game pieces and the second game pieces are placed over the plurality of pegs, the plurality of first game pieces and the plurality of second game pieces are freely rotatable about the peg.

4. The tic tac toe game of claim 3, wherein the cavity of each cylinder piece is substantially cylindrical in shape.

5. The tic tac toe game of claim 4, wherein the cavity of each cylinder piece defines a first diameter and each peg of the plurality of pegs defines a second diameter, with the first diameter being greater than the second diameter.

6. The tic tac toe game of claim 5, wherein the plurality of pegs are detachable from the base board.

7. The tic tac toe game of claim 6, wherein the upper end of each cylinder provides an upper opening communicating with the cavity, and wherein the recessed lip is disposed along a circumferential wall defining the upper opening.

8. A method of playing a game of tic tac toe, the method comprising the steps of: providing a game board comprising a base board and a plurality of pegs extending vertically upwardly from the base board; providing a plurality of first game pieces, each first game piece comprising a cylinder piece and an O-piece coupled thereto; and providing a plurality of second game pieces, each second game piece comprising a cylinder piece and an X-piece coupled thereto; defining a cavity in each cylinder piece, wherein each cylinder piece of the first and second game pieces provides a recessed lip portion adjacent an upper end thereof so that each respective O-piece or X-piece is snapably engageable to the recessed lip; and placing the first game pieces and the second game pieces over the plurality of pegs, with the plurality of pegs being received within the cavities of the cylinder pieces; further comprising blank tiles, wherein each blank tile comprises a tile protrusion projecting from a lower surface thereof, wherein each tile protrusion has a radial tile ridge dimensioned and shaped to facilitate the snapable engagement.

9. The method of claim 8, wherein the plurality of first game pieces and the plurality of second game pieces substantially cover the plurality of pegs.

10. The method of claim 9, wherein the cavity of each cylinder piece is substantially cylindrical in shape.

11. The tic tac toe game of claim 7, each game piece comprising a protrusion projecting from a lower surface thereof, wherein each protrusion has a radial ridge dimensioned and shaped to facilitate the snapable engagement.

12. The tic tac toe game of claim 11, wherein a lower end of each cylinder provides a lower opening communicating with the cavity, and wherein the upper opening has a diameter less than a diameter of the lower opening.

13. A tic tac toe game comprising: a game board comprising a base board and a plurality of pegs extending vertically upwardly from the base board; a plurality of first game pieces, each first game piece comprising a cylinder piece and an O-piece coupled thereto; and a plurality of second game pieces, each second game piece comprising a cylinder piece and an X-piece coupled thereto, wherein each cylinder piece of the first and second game pieces defines a cavity therein, wherein each cylinder piece provides a groove adjacent an upper end thereof so that each respective O-piece or X-piece is removably engageable to the groove, whereby individuals are enabled to removably substitute the pluralities of game pieces and, whereby in use, the first game pieces and the second game pieces are placed over the plurality of pegs, with the plurality of pegs being received within the cavities of the cylinder pieces; further comprising one or more blank tiles, wherein each blank tile comprises a tile protrusion projecting from a lower surface thereof, wherein each tile protrusion has a tile ridge dimensioned and shaped to operatively engage with the groove.

14. The tic tac toe game of claim 13, wherein the upper end of each cylinder provides an upper opening communicating with the cavity, and wherein the groove is disposed along a circumferential wall defining the upper opening.

15. The tic tac toe game of claim 14, each game piece comprising a protrusion projecting from a lower surface thereof, wherein each protrusion has a ridge dimensioned and shaped to operatively associate with the groove.

16. The tic tac toe game of claim 15, wherein a lower end of each cylinder provides a lower opening communicating with the cavity, and wherein the upper opening has a diameter less than a diameter of the lower opening.

* * * * *